US006438875B1

(12) United States Patent
Kimble et al.

(10) Patent No.: US 6,438,875 B1
(45) Date of Patent: Aug. 27, 2002

(54) EXCAVATOR ARM ASSEMBLY WITH INTEGRAL QUICK COUPLER

(75) Inventors: Allen E. Kimble, Uniontown, OH (US); Yonezo Inoue, Chattanooga, TN (US)

(73) Assignee: JRB Company, Inc., Akron, OH (US)

( * ) Notice: Subject to any disclaimer, the term of this patent is extended or adjusted under 35 U.S.C. 154(b) by 0 days.

(21) Appl. No.: 09/613,999

(22) Filed: Jul. 11, 2000

Related U.S. Application Data

(60) Provisional application No. 60/143,345, filed on Jul. 12, 1999.

(51) Int. Cl.[7] ..... E02F 3/28
(52) U.S. Cl. ..... 37/468
(58) Field of Search ..... 37/403, 468, 231, 37/409; 172/272, 273, 275, 439, 450, 456; 414/423; 403/31, 320–325

(56) References Cited

U.S. PATENT DOCUMENTS

| | | | | |
|---|---|---|---|---|
| 5,581,917 A | | 12/1996 | Barden | |
| 5,692,325 A | * | 12/1997 | Kuzutani | 37/468 |
| 6,058,633 A | * | 5/2000 | Barden | 37/468 |
| 6,074,120 A | * | 6/2000 | Williams | 403/326 |
| 6,158,950 A | * | 12/2000 | Wilt et al. | 414/723 |

FOREIGN PATENT DOCUMENTS

| | | |
|---|---|---|
| AU | B-18602/83 | 3/1984 |
| EP | 0184282 A1 | 6/1986 |
| EP | 0468771 A1 | 1/1992 |
| GB | 2330568 | 4/1999 |

* cited by examiner

*Primary Examiner*—Robert E. Pezzuto
(74) *Attorney, Agent, or Firm*—Fay, Sharpe, Fagan, Minnich & McKee, LLP

(57) ABSTRACT

An arm assembly for an excavator or the like includes a quick coupler integrated into an arm member and an implement link member, thus eliminating the need to connect a separate quick coupler to the arm. The arm member includes: (i) a proximal end adapted for connection to an associated boom for pivoting movement about a transverse pivot axis; (ii) a distal end, spaced from the proximal end along a first longitudinal axis; and, (iii) a first recess defined in the distal end. The first recess is defined about a first transverse axis that lies parallel to the transverse pivot axis and includes an open mouth and a closed inner end. The implement link member includes: (i) a first end; and, (ii) a second end spaced from the first end along a second longitudinal axis and defining a second recess about a second transverse axis parallel to the first transverse axis. The second recess has an open mouth and a closed inner end, and the first and second recesses are adapted for respective receipt of first and second associated pins of an associated implement. One or more dude links maintain a fixed spacing between the recesses and capture at least one of the pins of the associated implement in its respective recess at all times. An additional lock member closes the mouth of at least one of the recesses after an associated pin is received therein.

11 Claims, 12 Drawing Sheets

EXCAVATOR ARM ASSEMBLY WITH INTEGRAL QUICK COUPLER

CROSS-REFERENCE TO RELATED APPLICATION

This application claims priority from and hereby expressly incorporates by reference commonly owned U.S. Provisional Application No. 60/143,345 filed Jul. 12, 1999.

BACKGROUND OF THE INVENTION

The present invention relates generally to coupling devices used by equipment to facilitate selective, secure, and convenient attachment of various implements to the equipment as required to perform certain operations. More particularly, the present invention relates to an arm assembly for an excavator or the like, wherein the arm includes an integral quick coupler mechanism on its distal end adapted for attachment to any of a wide variety of implements without requiring attachment and use of a separate, conventional quick coupler mechanism intermediate the arm and the implement. For simplicity, the present invention is described primarily for use with excavator-type construction machinery. However, the term "excavator" as used herein is not intended to limit the type of vehicles or machines with which the present invention can be used. Specifically, the present invention can be used in connection with excavators, backhoes, tractors, skid-steer vehicles, fixed pedestal-mounted machines, or any other similar or related device.

Excavators are well known and widely used in various industries. Typically, such excavators include a boom extending from a base of the excavator to an outwardly and upwardly extending distal end, at which end an arm is attached. The arm pivots relative to the boom, and the distal end of the arm is adapted for operative securement of an attachment or implement such as a shovel or bucket for removing and depositing earth or the like. Other industries, such as the materials handling or demolition industries, employ shears, grapples, magnets, and other such devices at the distal end of the arm. Regardless of the type of implement employed at the end of the arm, it will be understood by those skilled in the art that an excavator employs fluid cylinders and the like for raising and lowering the boom, the arm, for moving the implement relative to the arm, and for operating any mechanisms of the implement, itself.

To improve the utility and versatility of excavators, it is most desirable that various implements be conveniently and reliably coupled to the arm. This, then, allows a single excavator to be employed with any one of a wide variety of implements as desired. However, given the size and weight of the implements, and the close tolerances of all connection points, changing of implements at the end of the arm of an excavator has been found to be time-consuming, difficult, labor-intensive, and can be dangerous.

In a most basic arrangement, the implements are manually pinned to the excavator arm and any associated fluid cylinders. Such operation necessarily requires manual removal and replacement of multiple pins to achieve the desired engagement. The removal and placement of such pins involves manually and hydraulically manipulating the heavy and cumbersome arm, a fluid cylinder, and/or the implement.

More recently, quick couplings have been developed and have enjoyed widespread commercial success. One suitable coupling is commercially available from JRB Company, Inc., Akron, Ohio under the trademark SLIDE-LOCO®. Such quick couplings are pivotably pinned to the distal end of the arm and also to the distal end of an implement or "bucket link member. Once a quick-coupler is operatively pinned in position, first and second recesses thereof are adapted for selective connection to first and second pins of any of a wide variety of associated implements as desired in a convenient and secure manner without removal of the first and second pins.

Although highly effective and convenient, these prior quick couplings add some weight to the excavator arm, and also elongate the arm, the combination of which can lead to a decrease in excavator performance in certain circumstances. The additional weight of the quick coupling can decrease the lifting capacity of the excavator. Further, the additional arm length and weight can lead to instability of the excavator when the boom and arm are extended. To compensate, some operators have been known to use smaller implements than required.

In light of the foregoing, a need has been identified for an arm assembly integrally incorporating a quick coupling mechanism adapted for selectively mating with and retaining an associated implement in a convenient and secure manner, without requiring attachment of a separate quick coupling device.

SUMMARY OF THE INVENTION

In accordance with a first aspect of the present invention, an arm assembly for an excavator or the like includes a quick coupler integrated into an arm member and an implement link member, thus eliminating the need to connect a separate quick coupler to the arm.

In accordance with another aspect of the present invention, the arm member includes: (i) a proximal end adapted for connection to an associated boom for pivoting movement about a transverse pivot axis; (ii) a distal end, spaced from the proximal end along a first longitudinal axis; and, (iii) a first recess defined in the distal end. The first recess is defined about a first transverse axis that lies parallel to the transverse pivot axis and includes an open mouth and a closed inner end.

In accordance with a further aspect of the present invention, the implement link member includes: (i) a first end; and, (ii) a second end spaced from the first end along a second longitudinal axis and defining a second recess about a second transverse axis parallel to the first transverse axis. The second recess has an open mouth and a closed inner end.

In accordance with still another aspect of the present invention, one or more dude links maintain a fixed spacing between the recesses and capture at least one of the pins of the associated implement in its respective recess at all times.

In accordance with another aspect of the invention, an additional lock member closes the mouth of at least one of the recesses after an associated pin is received therein.

One advantage of the present invention is the provision of an arm assembly for an excavator or other apparatus that incorporates an integral quick coupler.

Another advantage of the present invention resides in the provision of an arm assembly adapted for quick coupling with an associated implement without requiring use of a separate quick coupling mechanism.

A further advantage of the present invention is found in the provision of an arm assembly for an excavator or other apparatus, wherein the arm assembly is not significantly lengthened and wherein no significant additional weight is added relative to a conventional arm assembly.

Another advantage of the present invention is the provision of an arm assembly with an integral quick coupler mechanism wherein one or more dude links ensure that at least one attachment pin of an associated implement is fully captured at all times.

Still another advantage of the present invention resides in the provision of an arm assembly with an integral quick coupler mechanism including an implement lock mechanism for selectively capturing at least one attachment pin of an associated implement.

A yet further advantage of the present invention resides in the provision of an arm for an excavator or the like, wherein the distal end of the arm defines a pinreceiving recess that is fixed relative to the longitudinal axis of the arm.

A still further advantage of the present invention is found in the provision of an implement link member having a proximal end adapted for pivotable connection to a fluid cylinder and a distal end defining a recess that is fixed relative to the longitudinal axis of the link member.

Still other benefits and advantages of the present invention will become apparent to those of ordinary skill in the art to which the invention pertains upon reading and understanding the following specification.

BRIEF DESCRIPTION OF THE DRAWINGS

The invention takes form from various components and arrangements of components, preferred embodiments of which are illustrated in the accompanying drawings that form a part hereof and wherein.

DETAILED DESCRIPTION OF PREFERRED EMBODIMENTS

Figure 1A:
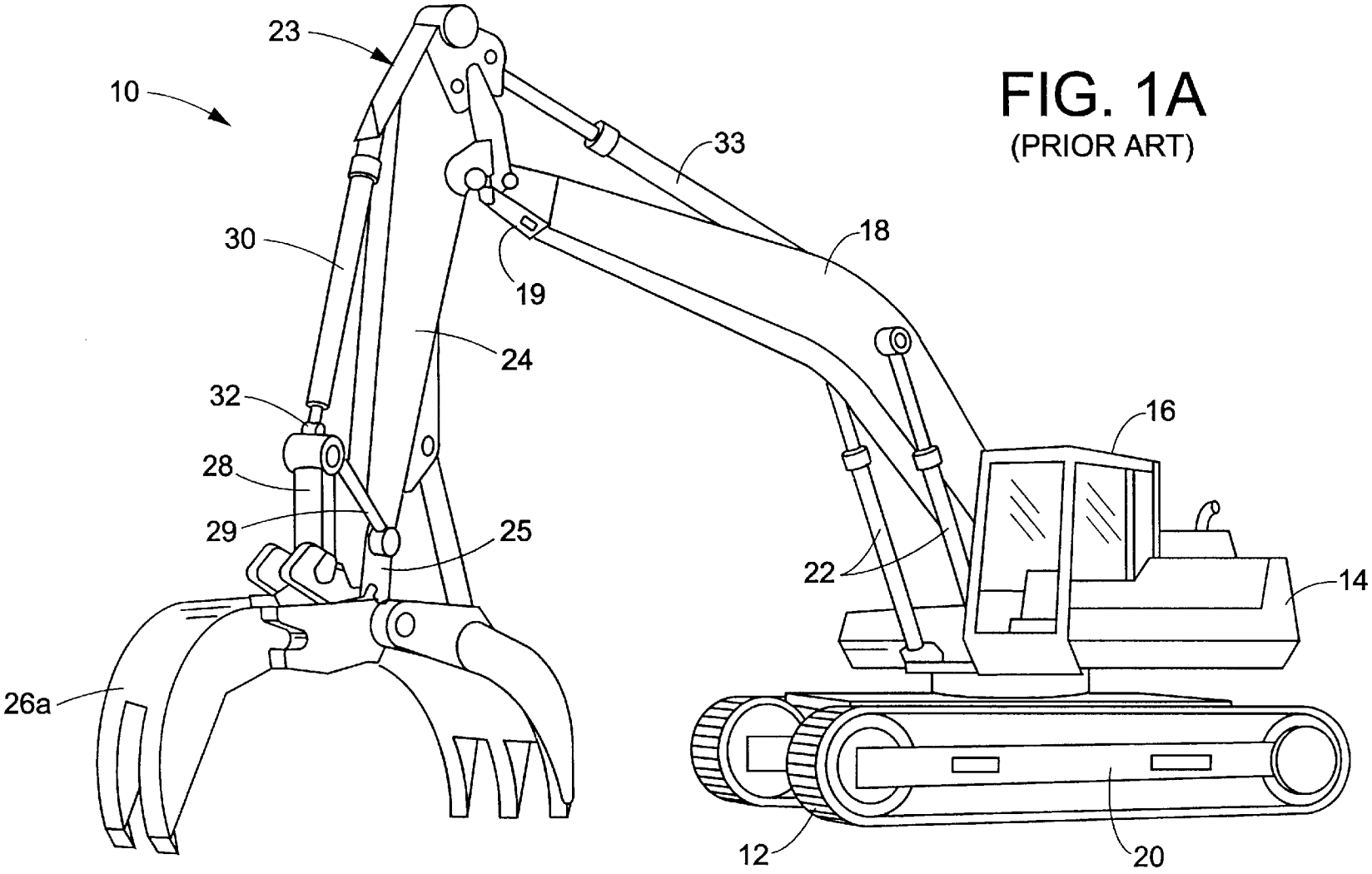
FIG. 1A (PRIOR ART)
FIG. 1A illustrates a conventional excavation device and associated implement or attachment.

Referring now to the drawings, wherein the showings are for purposes of illustrating preferred embodiments of the invention only and not for purposes of limiting same, FIG. 1A illustrates an excavator of the type in connection with which an excavator arm formed in accordance with the present invention may be advantageously employed. As noted above, the invention can be used in connection with any other excavation, construction, materials handling, demolition, or like apparatus having a boom to which an arm formed in accordance with the present invention can be operatively attached, and it is intended that the term excavator as used herein encompass all of same. The illustrated excavator 10 is movable upon tractor or roller chain treads 12 in standard fashion. An engine or power unit 14. such as a diesel engine or the like is operative to drive the treads 12 and the various hydraulic pumps, generators, and systems employed in the operation of the excavator as is well known. A cab 16 is maintained upon a base 20 for accommodating an operator controlling the excavator 10.

A boom 18 extends upwardly from the base 20 and is movable in elevation by means of hydraulic pistons 22. At the distal end 19 of the boom 18, the proximal end 23 of an arm or "dipper stick" 24 is pivotally attached for movement about a transverse pivot axis. In the embodiment shown, a shovel, bucket, or other implement 26*a* is maintained at the distal end 25 of the arm 24. An implement fluid cylinder 30 is operatively connected to the arm 24, and an implement or "bucket" link member 28 connects a piston 32 of the cylinder 30 to the bucket 26 or other implement to control operation of same as is well known and understood by those skilled in the art. A pair of guide links 29 (only one visible in FIG. 1A) are located on opposite lateral sides of the arm 24 and are pivotally connected to both the arm 24 and the implement link 28 to pivot about respective transverse axes. The guide links 29 maintain proper spacing between the implement link member 28 and the arm 24 during extension/retraction of the cylinder piston 32. In similar fashion, a fluid cylinder 33 is interposed between the boom 18 and arm 24 for achieving pivotal movement between these two members, again in a fashion well known and understood in the art.

Figure 1B:
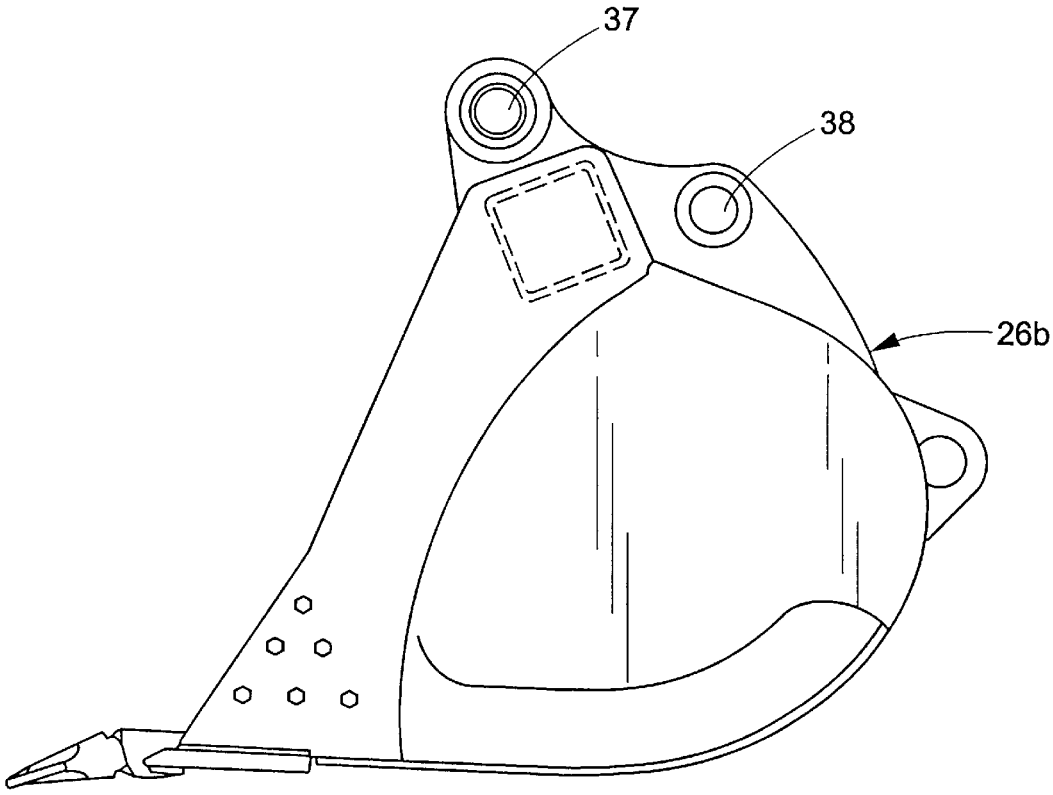
FIG. 1B (PRIOR ART)
FIG. 1B is a side elevational view of another conventional excavator attachment or implement.

FIG. 1B illustrates a conventional excavator bucket implement 26*b*. The implement 26*b* comprises first and second parallel and spaced-apart attachment pins 37,38 by which the implement 26*b* is pinned or quick-coupled to the excavator arm 24 and link 28.

Figure 1D:
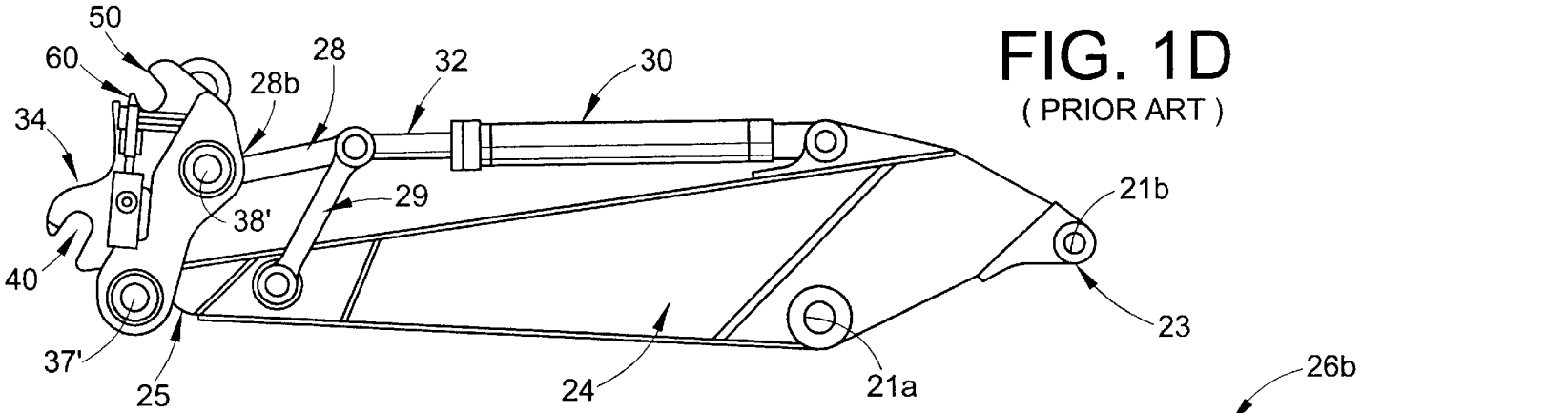
FIG. 1D ( PRIOR ART )
FIG. 1D is a side elevational view of the prior art arm of FIG. 1C including an associated separate prior art quick coupler mechanism.
Figure 1C:
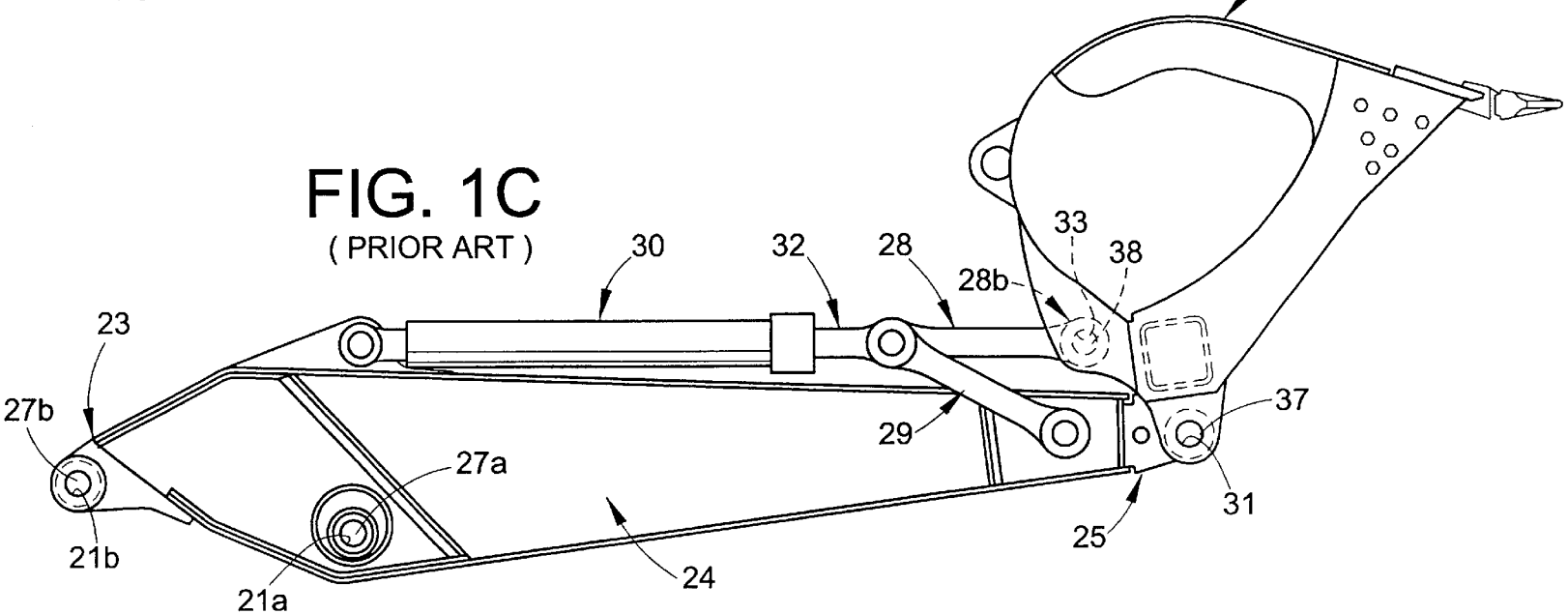
FIG. 1C ( PRIOR ART )
FIG. 1C is a side elevational view of a prior art arm for an excavator or the like and an associated bucket implement operatively pinned thereto in a conventional manner.

With reference now also to FIG. 1C, the implement 26*b* is directly pinned or otherwise coupled to closed eyelets or apertures 31,33 located at the distal end 25 of the arm 24 and to the distal end 28*b* of the link 28 using the implement attachment pins 37,38. This arrangement is undesirable when the implement 26*b* must be changed frequently given the inconvenience and time involved in switching implements. Specifically, the pins 37,38 must be removed and then axially inserted through the eyelets 31,33 and aligned apertures of the implement. The proximal end 23 of the arm 24 includes a first transverse cylindrical bore 21*a*, or a plurality of aligned transverse bores, centered on a first transverse pivot axis 27*a* and adapted for pivotable connection to an associated boom 18 so that the arm pivots relative to the boom about the first transverse pivot axis 27*a*. The proximal end 23 of the arm 24 also includes a second transverse cylindrical bore 21*b*, or a plurality of aligned transverse bores, centered on a second transverse pivot axis 27*b* that is parallel to the first transverse pivot axis. The bore 21*b* is used to pivotably couple the piston of the associated fluid cylinder 33 so that the piston and arm 24 pivot relative each other about the second transverse pivot axis 27*b*.

Another prior art arrangement is illustrated in FIG. 1D where the arm 24 comprises a separate quick coupler mechanism 34 pinned (by pins 37',38') to the distal end 25 of the arm 24 and the distal end 28*b* of the link 28. The quick coupler 34, in turn, is adapted for selective and convenient interconnection with an associated implement, such as the bucket 26*b*. Specifically, the quick coupler 34 includes first and second recesses 40,50 adapted for respective direct receipt of the first and second implement pins 37,38 without these pins being removed from an associated implement such as the implement 26*b*. A lock 60 is selectively extensible into the second recess 50 to capture the second pin 38 therein. The first recess 40 is formed so that, when the second pin 38 is captured in the second recess 50 by the lock 60, the first pin 37 cannot escape from the first recess 40. This type of quick coupler is highly effective and has enjoyed widespread commercial success. However, as is readily apparent, it extends the overall length of the arm 24 and add weight thereto and, thus, can limit performance under certain circumstances.

Referring now to FIGS. 2A–3B, an arm assembly 124 formed in accordance with the present invention is illustrated. Unless otherwise shown and/or described, like components relative to the arm 24 are identified with like reference numerals that are 100 greater than those used in connection with FIGS. 1A–1D.

The arm 124 comprises a proximal end 123 adapted for connection to a distal end 19 of an excavator boom 18 in a conventional manner. Unlike the arm 24, the distal end 125 of the arm 124 comprises a first integral implement attachment pin receiving area or recess 140 adapted for mating receipt of the first implement attachment pin 37 of an associated bucket or other implement without removal of the pin 37 from the implement. The recess 140 is preferably formed as a one-piece construction with the arm 124 or is otherwise permanently integral with the remainder of the arm 124 through, for example, a welding operation. Alternatively, the recess 140 is defined in a separate member secured to the arm via bolts or like fasteners. In either case, the first recess 140 is defined transversely (preferably perpendicularly) to the longitudinal axis L of the arm 124 and defines an open mouth 142 and a closed inner end 144, with at least a portion of the inner end defining an arcuate, preferably partially (e.g., semi) cylindrical, surface. The mouth 142 is defined at a fixed angle relative to the axis L (in a plane parallel to the planes in which the guide links 129 respectively move) and preferably opens downwardly, i.e., generally away from the fluid cylinder 130 and link member 128, although it can open in other directions without departing from the overall scope and intent of the invention. Although illustrated as a single recess, the recess 140 can be provided or defined by one or more aligned recesses without departing from the overall scope and intent of the present invention.

The fluid cylinder 130 includes a piston 132 that reciprocates along a path that extends in the general direction of the axis L. A bucket link or implement link 128 formed in accordance with the present invention is connected at its proximal end 128*a* to the piston 132 to reciprocate therewith and to pivot about a transverse axis relative thereto. The pair of guide links 129 are located on opposite lateral sides of the arm 124 and are pivotally connected at a first end to the proximal end 128*a* of the implement link (at a common pivot point relative to the piston 132) and at an opposite second end to the arm 124. The guide links 129 pivot about transverse axes and maintain proper spacing between the proximal end 128*a* of the implement link member 128 and the arm 124 during extension/retraction of the piston 132.

The distal end 128*b* of the implement link member 128 is spaced from the proximal end 128*a* on an axis L' and includes a second integral implement attachment pin receiving area or recess 150 adapted for mating receipt of the second implement attachment pin 38 of an associated bucket or other implement 26*b* without the pin 38 being removed from the implement. The recess 150 is preferably formed as a one-piece construction with the implement link 128 or is otherwise permanently integral with the remainder of the link 128 via welding or the like. Alternatively, the second recess 150 is defined in a separate member secured to the link 128 using bolts or like fasteners. In either case, the second recess 150 is defined transversely (preferably perpendicularly) to the longitudinal axis L' of the link member 128 and defines an open mouth 152 and a closed inner end.154, with at least a portion of the inner end 154 defining an arcuate, preferably partially (e.g., semi) cylindrical, surface. Owing to the fact that the first and second pins 37,38 of an associated attachment are typically parallel, the recesses 140,150 are preferably defined to lie parallel to each other on respective first and second transverse axes T1,T2 (FIGS. 3A,3B), wherein the associated pins 37,38 fully received in the recesses 140,150 (i.e., abutting the recess inner ends 144,154) are preferably positioned with their longitudinal axes aligned with the axes T1,T2, respectively. The axes T1,T2 are defined parallel to the transverse axes 127*a*,127*b*. Like the mouth 142 of the recess 140, the mouth 152 of the recess 150 is fixed angularly in a plane that lies perpendicular to the axes T1,T2 and preferably opens generally downwardly, i.e., toward the distal end 125 of the arm 124, although it can open in other directions without departing from the overall scope and intent of the invention. As noted with respect to the first recess, the second recess 150 can be defined by a single recess in a single member or by multiple aligned recesses in different members without departing from the scope and intent of the present invention.

As noted, the recesses 140,150 are preferably defined about and extend along respective axes T1 and T2. Those of ordinary skill in the art will recognize that these axes T1,T2 are preferably both parallel with the axes 127*a*,127*b* about which the arm 124 pivots relative to an associated boom and cylinder-piston of an excavator or like apparatus. Furthermore, as noted, the closed inner regions 144,154 of the recesses 140,150 are defined by arcuate surfaces preferably defined by radii R1,R2 centered on the axes T1,T2, respectively (see FIGS. 5A and 8B). Also, it is most preferred that the arcuate inner ends 144,154 of the recesses 140,150 lie diametrically opposed to the mouths 142,152, respectively.

Figure 2A:
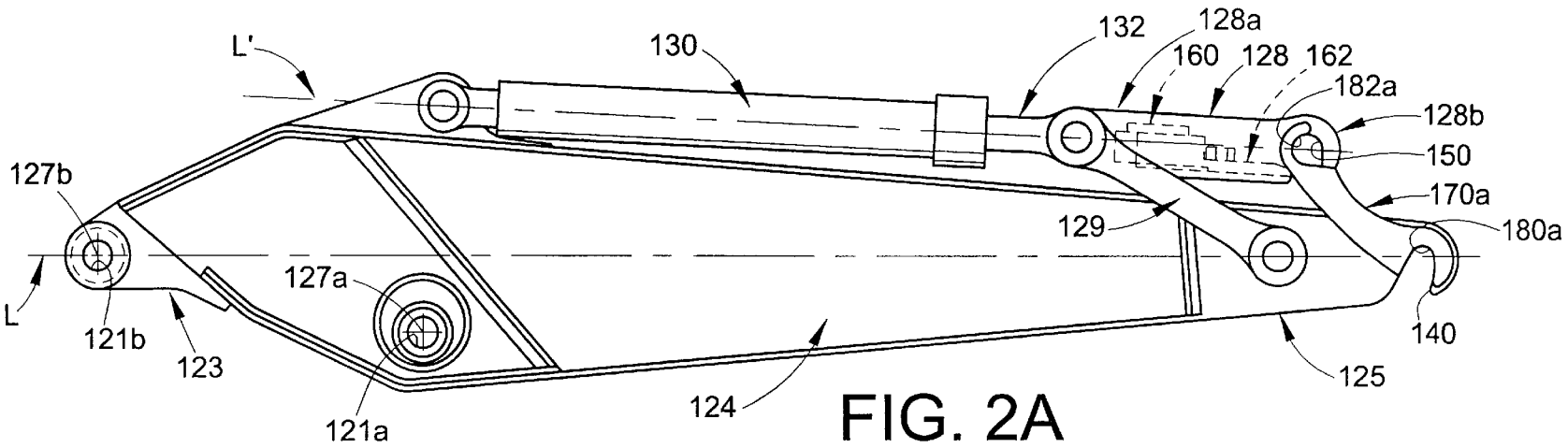
FIG. 2A is a right side elevational view of an arm for an excavator or the like with integral quick coupler formed in accordance with the present invention in a first operative position, and showing the implement lock in the disengaged condition (the left side being a mirror image)

With continuing reference to FIGS. 2A through 3B, the arm assembly 124 formed in accordance with the present invention also comprises an implement lock assembly 160. As shown, the lock assembly 160 is connected to the implement link 128 and includes a lock member 162 that moves between a first, unlocked or retracted position (FIG. 2A) and a second, locked or extended position (FIG. 2B). More particularly, the lock assembly 160 includes electric, hydraulic, manual, or other suitable means connected to the lock member 162 and adapted for moving same between the unlocked and locked positions as desired and as indicated by the arrow A in FIGS. 3A and 3B. In the unlocked or retracted position, the lock member 162 is retracted relative to and does not interfere with the second recess 150 so that the second attachment pin 38 of an associated implement is freely received in and removable from the recess 150 by way of the mouth 152. On the other hand, when the lock member 162 is moved into its second, locked or extended position as illustrated in FIG. 2A, it at least partially closes the mouth 152 of the second recess 150 or otherwise captures a second implement attachment pin 38 of an associated implement in the recess 150. Those of ordinary skill in the art will recognize that the arm 124, itself, may alternatively or additionally comprise a similar or identical lock assembly with a lock member movable between an unlocked and a locked position to selectively capture an implement attachment pin 37 in the first recess 140.

Figure 2B:
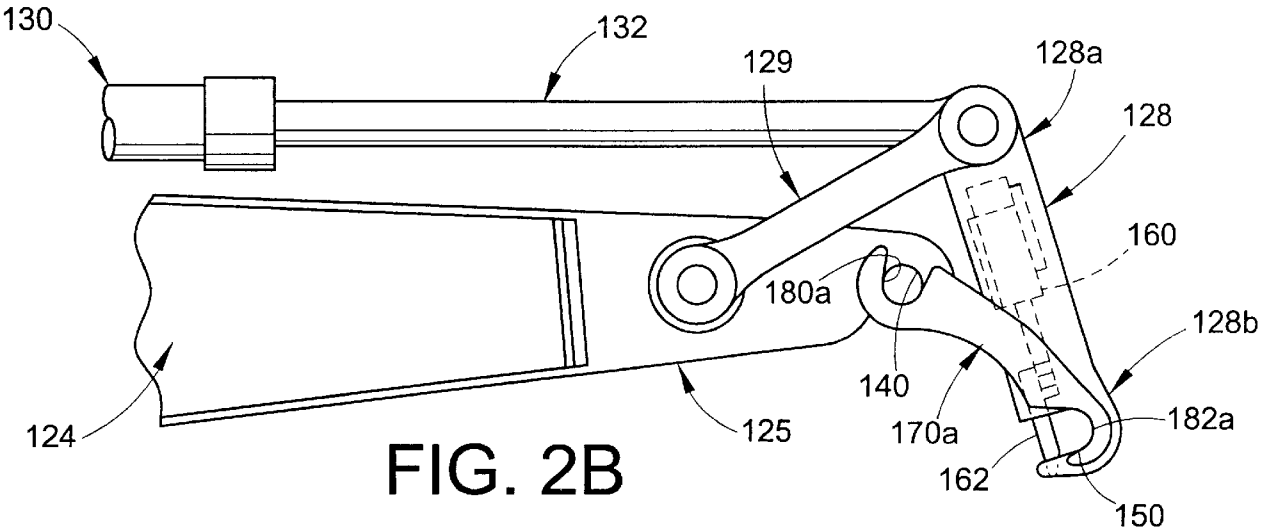
FIG. 2B is a partial side elevational view of the arm of FIG. 2A in a second operative position and showing the implement lock in its engaged condition.
Figure 3A:
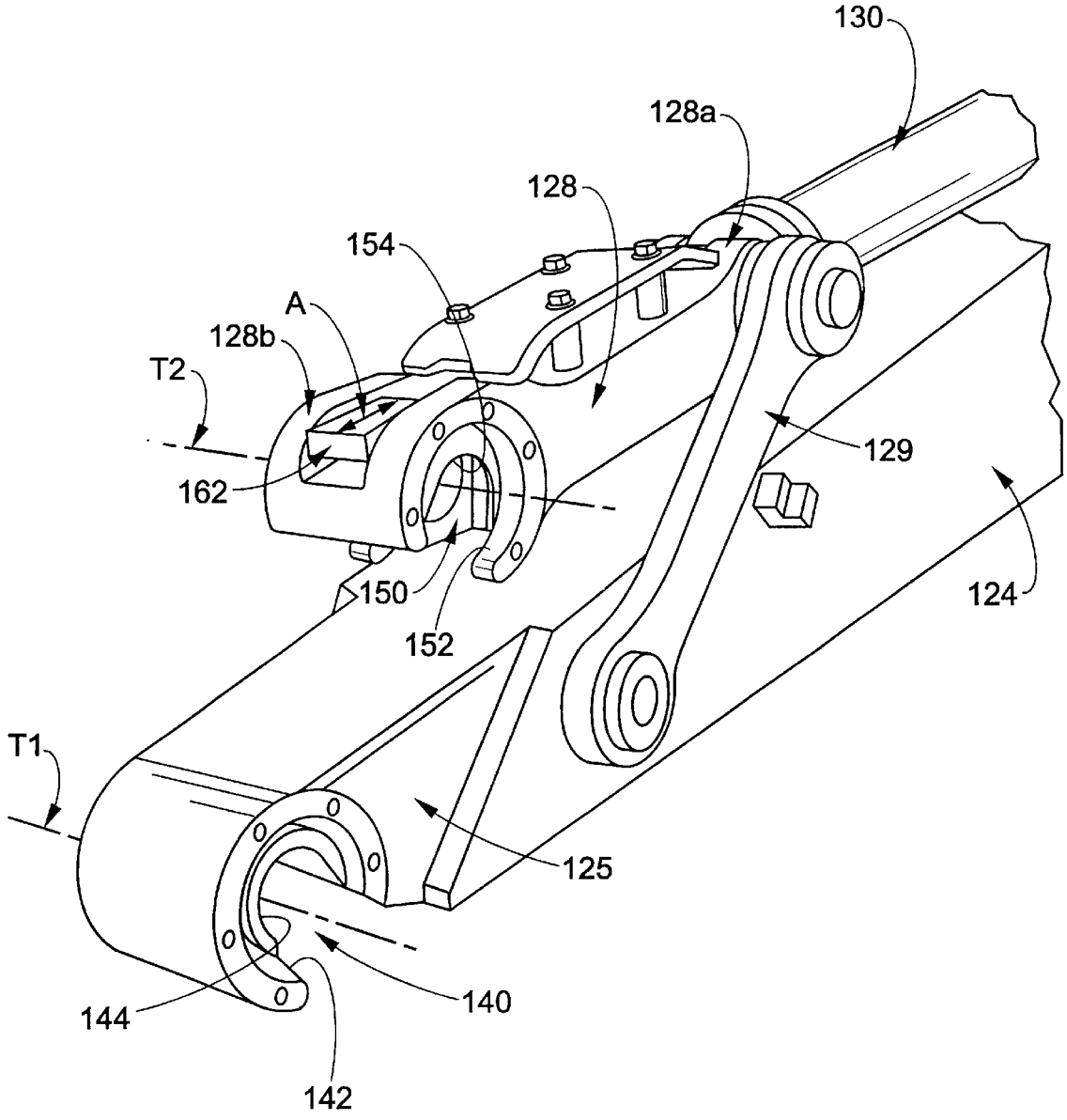
FIG. 3A is a perspective illustration of an arm with integral quick coupler formed in accordance with the present invention (with the dude links removed for clarity)

For clarity and ease of understanding the present invention, the arm assembly illustrated in FIG. 3A does not include the preferred first and second dude links 170*a*,170*b* (shown in FIGS. 2A, 2B, and 3B) mounted on opposite lateral sides of the arm 124 and pivotably connected at a first end to the distal end 125 of the arm 124 and pivotably connected at a second end to the distal end 128*b* of the implement link 128. The dude link 170*a* (FIGS. 2A,2B) includes first and second recesses 180*a*,182*a* defined at its opposite first and second ends that open in opposite directions relative to each other and that are adapted for receipt of the pins 37,38, respectively. The dude link 170*b* (FIG. 3B) is a mirror image of the dude link 170*a* and, thus, includes first and second recesses 180*b*,182*b* defined at its opposite first and second ends that open in opposite directions relative to each other. The first recesses 180*a*,180*b* and the second recesses 182*a*,182*b* open in the same direction relative to each other. As illustrated, it is most preferred that the dude links 170*a*,170*b* pivot relative to the distal end 125 of the arm 124 about the axis T1, and pivot relative to the distal end 128*b* of the implement link 128 about the axis T2.

The dude links 170*a*,170*b* perform multiple functions. Specifically, the dude links maintain a fixed spacing between the distal end 125 of the arm 124 and the distal end 128*b* of the implement link 128 so that the spacing between the axes T1,T2 of the recesses 140,150 always equals the spacing between the longitudinal axes of the pins 37,38 of an associated implement 26*b*. Secondly, as described below, the dude links 170*a*,170*b* always close or block the mouth 142,152 of at least one of the recesses 140,150 so that at least one pin 37,38 of an associated implement is always captured in its respective recess 140,150.

Figure 3B:
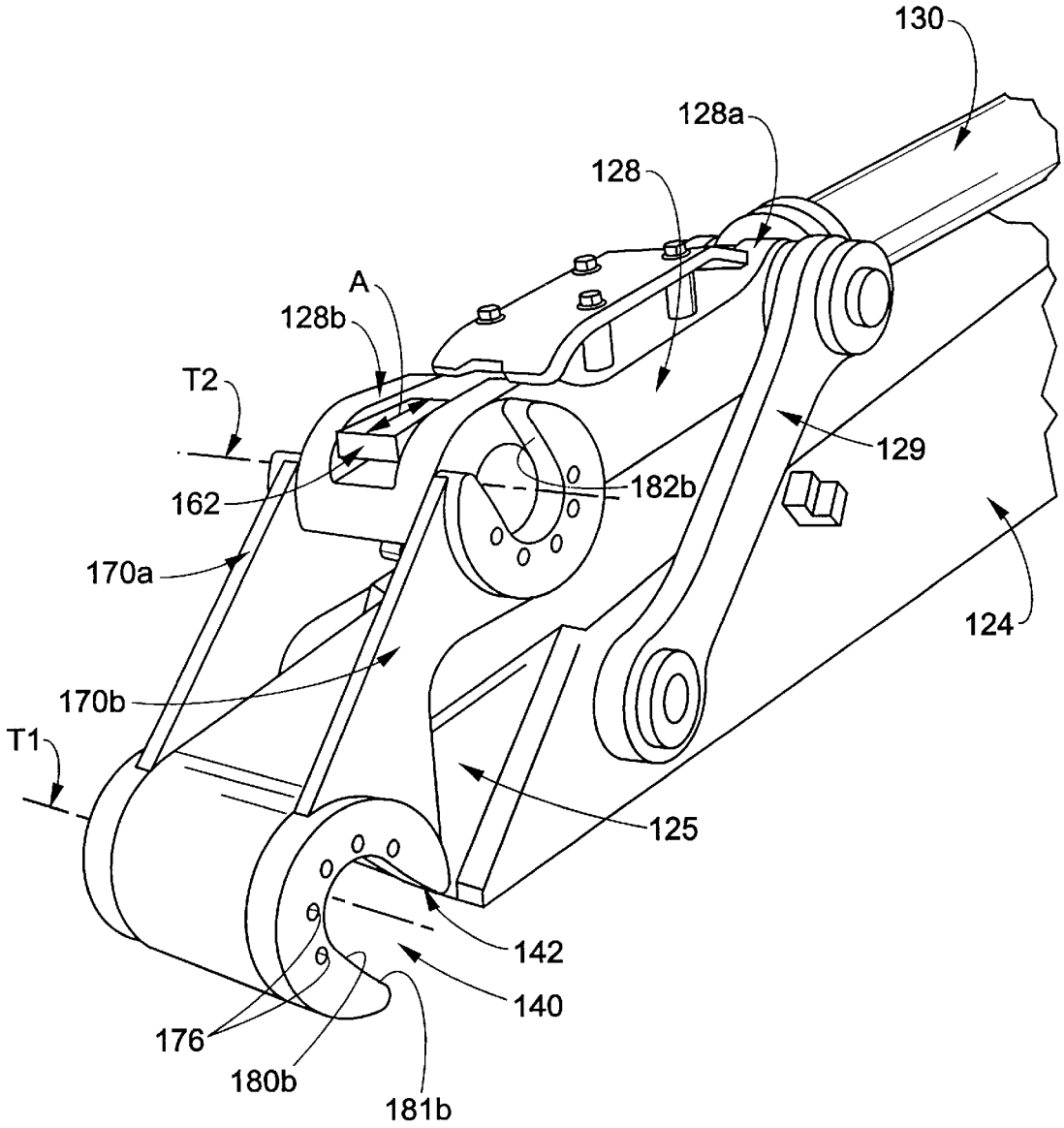
FIG. 3B is similar to FIG. 3A, but also shows the dude links.
Figure 4A:
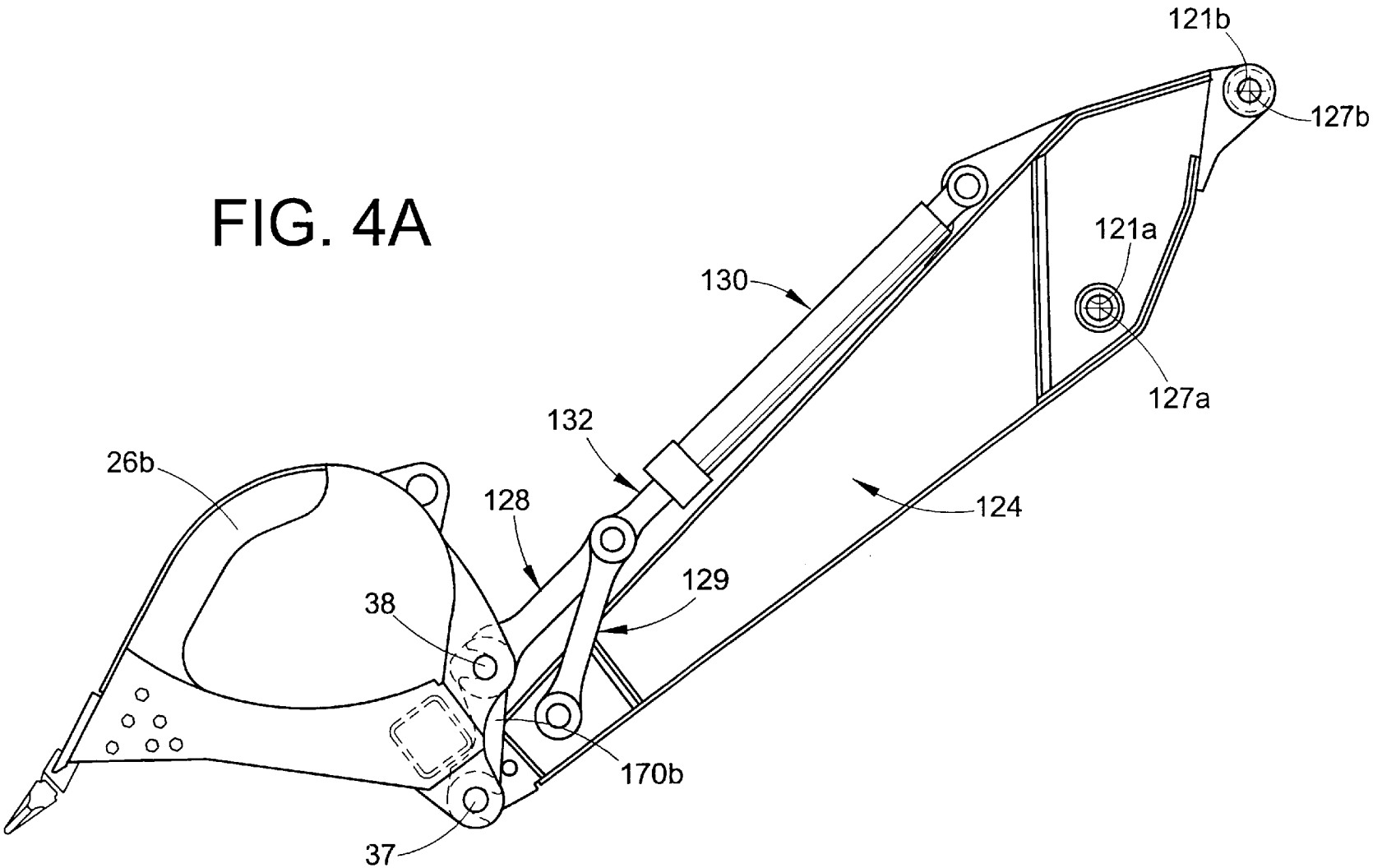
FIG. 4A is a side elevational view of the arm assembly of FIG. 2A in its first position including a bucket implement operatively secured thereto.

The dude links 170*a*,170*b* are conformed and oriented so that when the cylinder piston 132 is retracted (as shown in FIGS. 2A, 3B, and 4A) the second recesses 182*a*,182*b* thereof lie opposed to or open in a direction generally opposite and non-registered with the mouth 152 of the second recess 150. Accordingly, when a pin 38 of an associated implement is located in the recess 150, the second recesses 182*a*,182*b* of the dude links 170*a*,170*b* capture the associated pin 38. At the same time, the first recesses 180*a*,180*b* of the dude links 170*a*, 170*b* register with or are open in the same general direction as the mouth 142 of the first recess 140. Thus, the dude links 170*a*,170*b* do not capture the first attachment pin 37 of an associated implement in the recess 140 when the cylinder piston is retracted. This is important because, in this position, the dude links 170*a*, 170*b* also do not block insertion of the associated pin 37 directly into the recess 140 as required to effect quick coupling, i.e., direct coupling without axial insertion/removal of the pin 37.

Figure 4B:
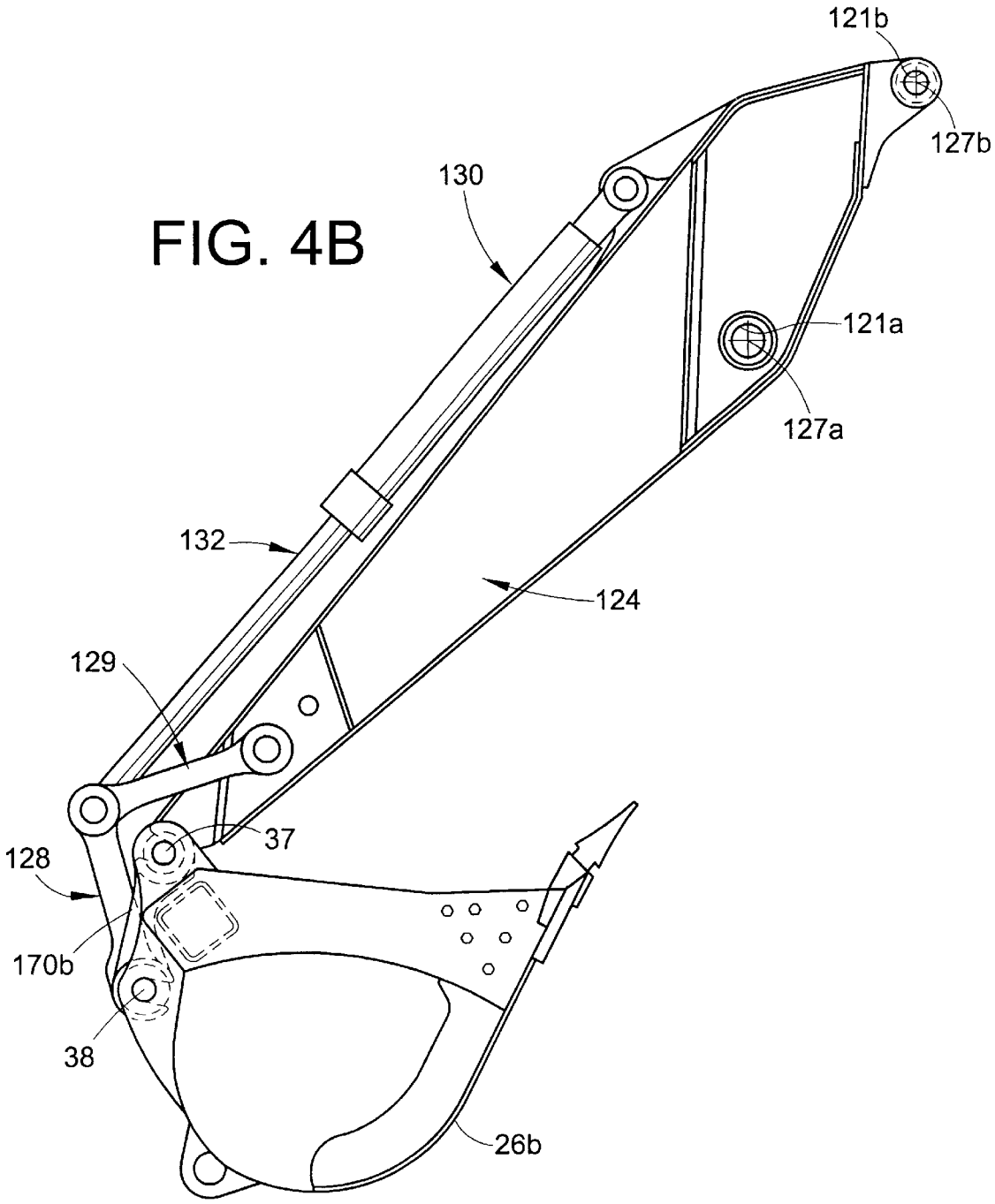
FIG. 4B is similar to FIG. 4A, but shows the arm and bucket implement in a second operative position.

In contrast, referring now to FIGS. 2B and 4B, the cylinder piston 132 and implement link 128 are extended. When the implement link 128 is in this extended position, the dude links 170*a*, 170*b* pivot so that the second recesses 182*a*, 182*b* thereof open in the same direction or register with and do not block the mouth 152 of the second recess 150. Accordingly, in this position, the dude links 170*a*, 170*b* do not oppose the second recess 150 and do not capture the second attachment pin 38 of an associated implement 26*b* therein. Also, in this position, the pin 38 is freely received in the recess 150 during quick coupling operations. However, when the implement lock 160 is engaged as shown in FIG. 2B, the lock member 162 will still capture and prevent escape of the attachment pin 38 of an associated implement 26*b*. At the same time, the first recess 180*a*,180*b* of each dude link 170*a*,170*b* is now oriented opposite the first recess 140 of the arm 124 so as to capture the first associated implement attachment pin 37 therein. Thus, even in the unlikely event that the implement lock 160 is inadvertently disengaged and the lock member 162 retracted, the first recesses 180*a*,180*b* of the dude links 170*a*,170*b* prevent complete detachment of the associated implement 26*b* from the arm 124.

From the foregoing, those of ordinary skill in the art will recognize that the dude links 170*a*,170*b* ensure that at least one of the pins 37,38 of an associated implement 26*b* is fully captured in its respective recess 140,150 of the arm 124 and implement link 128 at all times, regardless of whether the cylinder piston 132 is extended, retracted, or at some intermediate position between fully extended and fully retracted. Further, those of ordinary skill in the art will recognize that the dude links perform this safety task without interfering with quick coupling operations as described in further detail below.

In use, to quick couple an implement 26*b* to the arm 124, the arm is placed in the condition illustrated in FIG. 2A. This moves the dude links 170*a*,170*b* to a first position where the associated implement attachment pin 37 is freely received directly in the arm recess 140 by way of the mouth 142. The arm 124 is then lifted so that the implement 26*b* is lifted by the pin 37 in the recess 140, and the piston 132 is fully extended. This causes the dude links 170*a*,170*b* to pivot to a second operative position, thus capturing the implement pin 37 in the recess 140 while opening the recess 150 of the link member 128 (FIG. 4B). At the same time, the second recess 150 pivots relative to the first recess 140 about the axis T1 so that the second associated implement attachment pin 38 is received directly in the second recess 150 of the implement link 128 through the mouth 152 as illustrated in FIG. 4B. Finally, the lock 160 is engaged (FIG. 2B) so that the lock member 162 captures the second associated pin 38 in the recess 150. Detachment of the implement 26*b* is simply the reverse of the attachment operation.

Figure 5B:
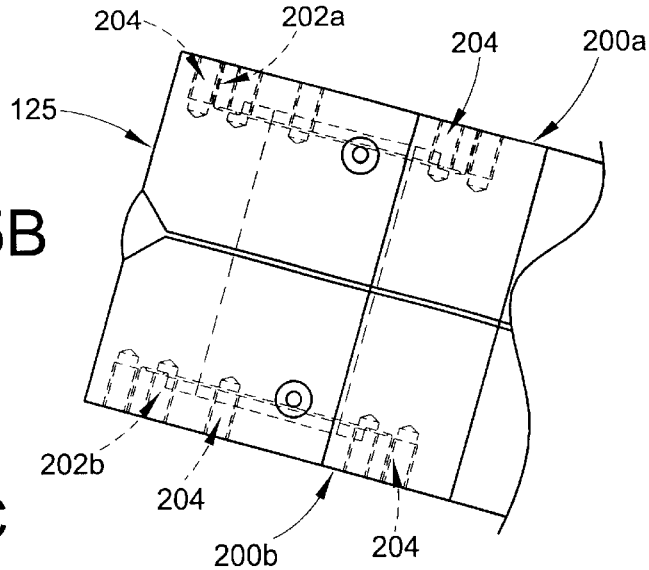
FIG. 5B is a top plan view taken along line B—B of FIG. 5A.
Figure 5A:
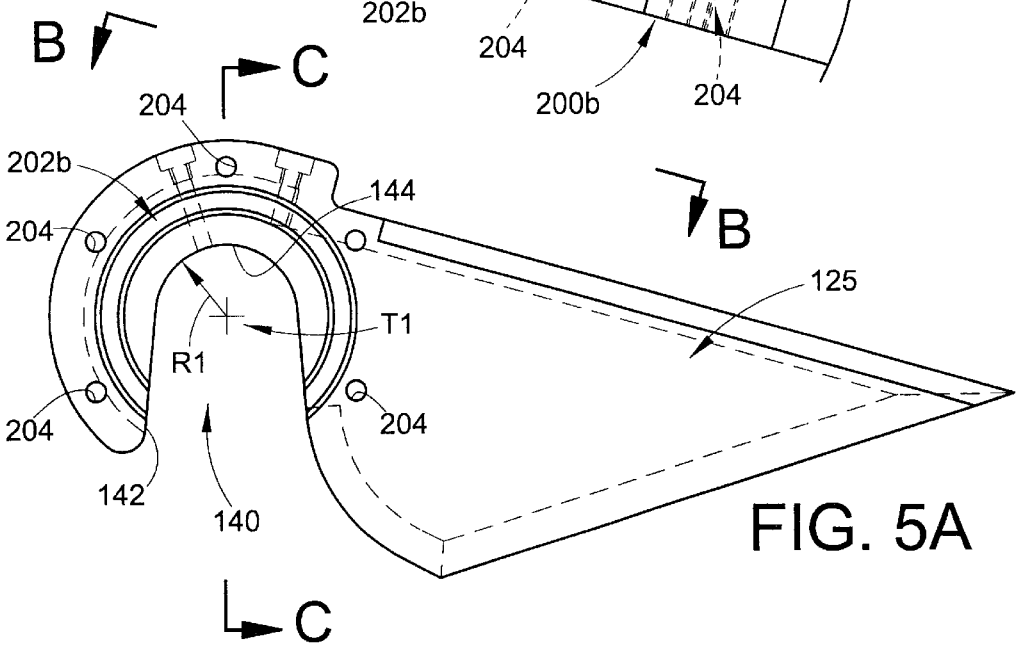
FIGS. 5A is a left side elevational view of a distal end of an arm formed in accordance with the present invention (the right side being a mirror image)
Figure 5C:
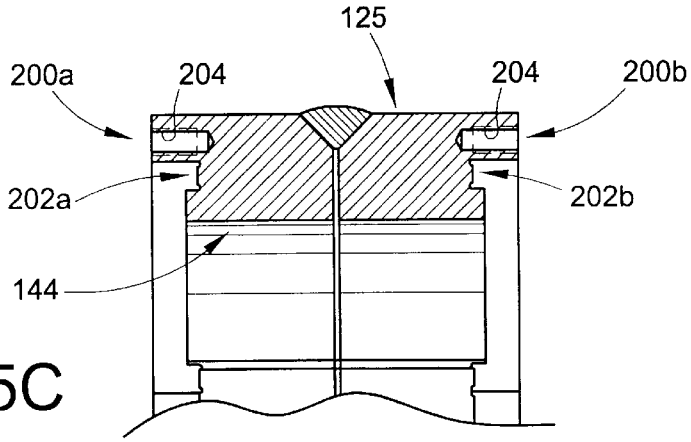
FIG. 5C is a sectional view taken along line C—C of FIG. 5A.

FIGS. 5A–5C illustrate a preferred construction of the distal end 125 of the arm 124. The distal end 125 can be a separate assembly or construction that is welded or otherwise fixedly secured to the remainder of the arm 124. The distal end 125 defines first and second circular grooves 202*a*,202*b* in first and second opposite lateral faces 200*a*, 200*b*. The grooves 202*a*,202*b* are preferably concentric about the axis Ti and circumscribe the recess 140 as shown. Of course, the grooves 202*a*,202*b* are interrupted by the mouth 142 of the recess 140. A plurality of threaded bores 204 are also defined in each opposite lateral side 200*a*,200*b* of the arm distal end 125, preferably spaced radially outwardly from the grooves 202*a*,202*b* and extending parallel to the axis T1.

Figure 7:
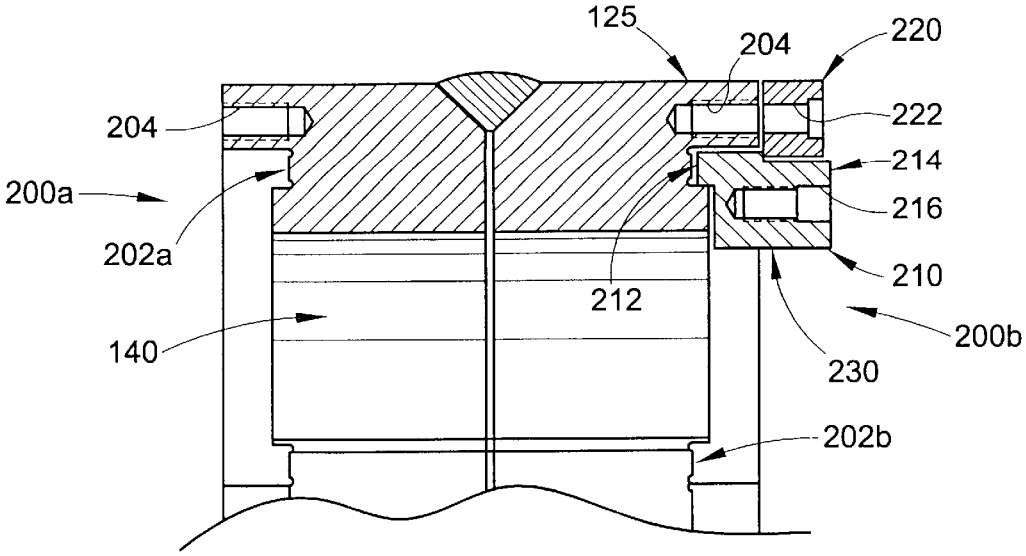
FIG. 7 is similar to FIG. 5C, but shows operative connection of the dude link retainer of FIG. 6A to the distal end of the arm.
Figure 6A:
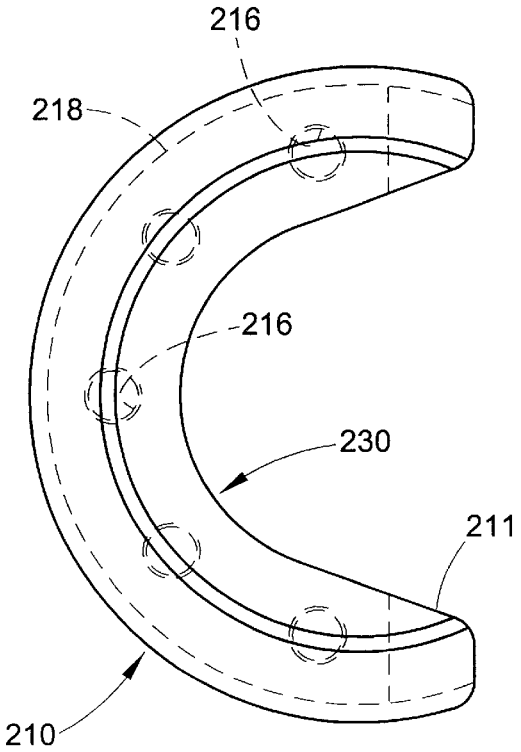
FIG. 6A is a side elevational view of a dude link retainer formed in accordance with the present invention.
Figure 6B:
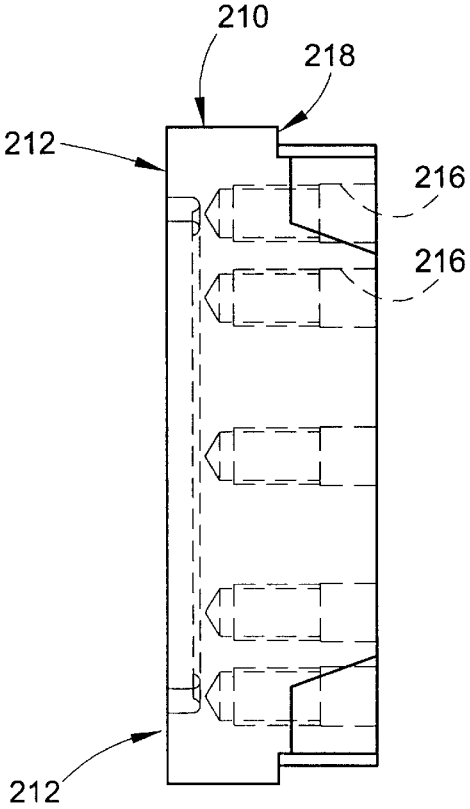
FIG. 6B is a front elevational view of the dude link retainer of FIG. 6A.

Referring now also to FIGS. 6A–7, a preferred construction for pivotable connection of the dude link 170*b* to the arm assembly 124 is disclosed. Those of ordinary skill in the art will recognize that connection of the dude link 170*a* to the distal end 125 of the arm is identical. The arm assembly comprises a C-shaped retainer 210 including an inner face defining an arcuate projection 212 adapted for close, sliding receipt in the groove 202*a* (see FIG. 7). A keeper ring 220 (or a plurality of separate keeper elements), preferably C-shaped so as to overlie the bores 204 without obstructing the mouth 142 of the recess 140, is fixedly secured to the distal end 125 of the arm 124 using bolts or other fasteners (not shown) that are threadably received in bores 222 of the keeper ring 220 and an aligned one of the bores 204. The keeper ring 220 engages a shoulder 218 on the retainer 210 and, thus, holds the retainer 210 in the groove without inhibiting its sliding movement in the groove 202*a*.

The retainer 210, itself, defines a plurality of threaded bores 216 that open in an outer face thereof and to which the dude link 170*b* is fixedly secured. Specifically, with reference also to FIG. 3B, the dude link 170*b* defines a plurality of bores 176 that receive fasteners that are, in turn, threadably secured in respective aligned bores 216 of the retainer 210. The dude link 170*b* and the retainer 210 are fixedly secured together and move as a unit relative to the groove 202*a* so that an open portion 211 of the retainer is aligned or registered with the open portion or mouth 181*b* (FIG. 3B) of the dude link recess 180*b*. Furthermore, the retainer 210 is of a sufficient arcuate length so that it can bridge and move through the mouth 142 of the recess 140 without becoming dislodged from the groove 202*a*. The opposite dude link 170*a* is connected to the distal end 125 of the arm 124 in a corresponding manner as will be readily appreciated by one or ordinary skill in the art. It is preferred that, when the various components are assembled as described, an inner arcuate surface portion 230 of the retainer 210 is centered on an rotates about the relevant axis T1,T2 and closely abuts the outer cylindrical surface of an associated pin 37,38 held in the relevant recess 140,150.

Figure 8A:
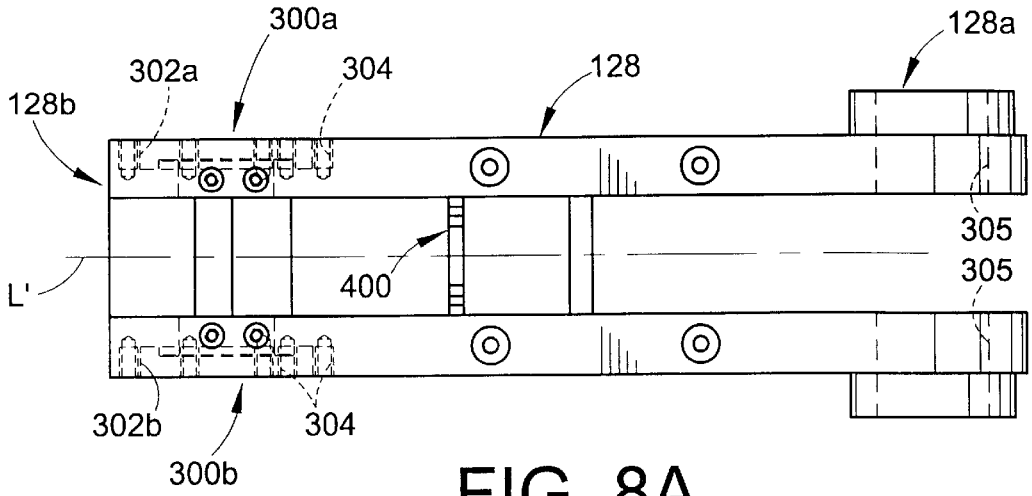
FIG. 8A is a top plan view of an implement link formed in accordance with the present invention.
Figure 8B:
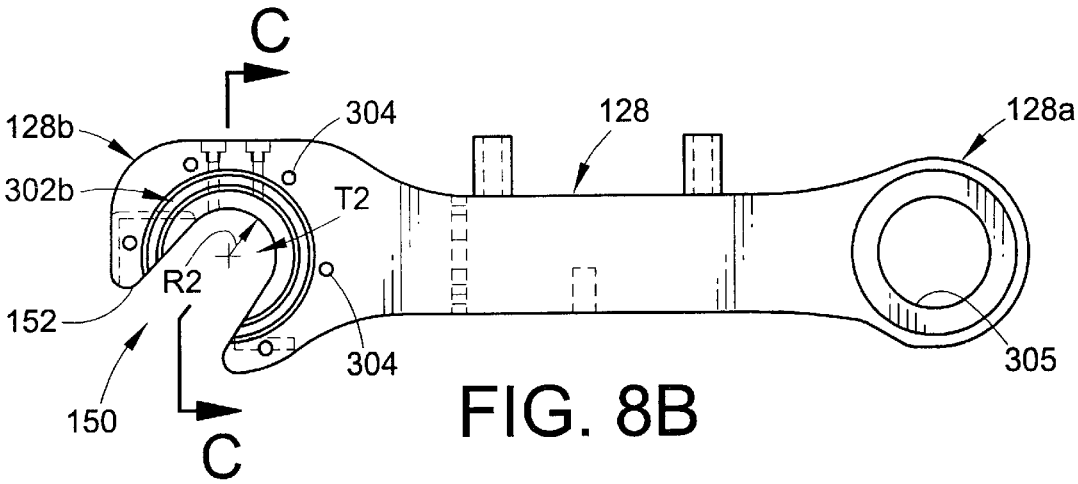
FIG. 8B is a side elevational view of the implement link of FIG. 8A; and, FIG. 8C is a sectional view taken along lines C—C of FIG. 8B; and, FIG. 9 is a side view of the implement link of FIG. 8B, and further illustrating an implement lock secured thereto.
Figure 8C:
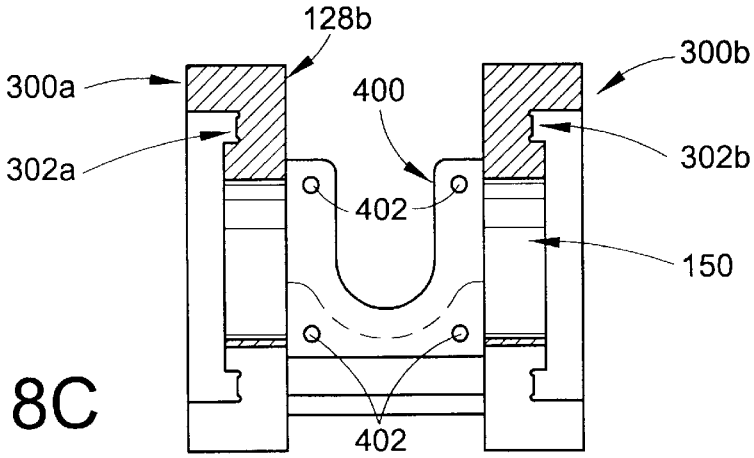

FIGS. 8A–8C illustrate a preferred construction of an implement link 128 formed in accordance with the present invention. The proximal end 128*a* is conventional and defines a transverse bore 305 for receipt of a pin to operably and pivotably couple the link 128 to a piston of the fluid cylinder 130 so that the link and piston pivot relative to each other about a transverse axis. The distal end 128*b* is defined similarly to the distal end 125 of the arm 124 in that it includes first and second circular. grooves 302*a*,302*b* defined in first and second opposite lateral faces 300*a*,300*b*. The grooves 302*a*,302*b* are preferably concentric about the axis T2 and circumscribe the recess 150 as shown, but are interrupted by the mouth 152 thereof. A plurality of threaded bores 304 are also defined in each opposite lateral side 300*a*,300*b* of the distal end 128*b*, preferably spaced radially outwardly from the grooves 302*a*,302*b*, and extending parallel to the axis T2.

The pivotable connection of the dude links 170*a*,170*b* to the distal end 128*b* of the implement link member is preferably identical to the pivotable connection of the dude links 170*a*,170*b* to the distal end 125 of the arm 124, using retainers such as the retainer 210 and keepers such as the keeper ring 220, although the grooves 302*a*,302*b* and the noted components can be dimensioned differently than those used to pivotably connected the dude links 170*a*,170*b* to the arm 124, if desired, without departing from the overall scope and intent of the present invention.

Figure 9:
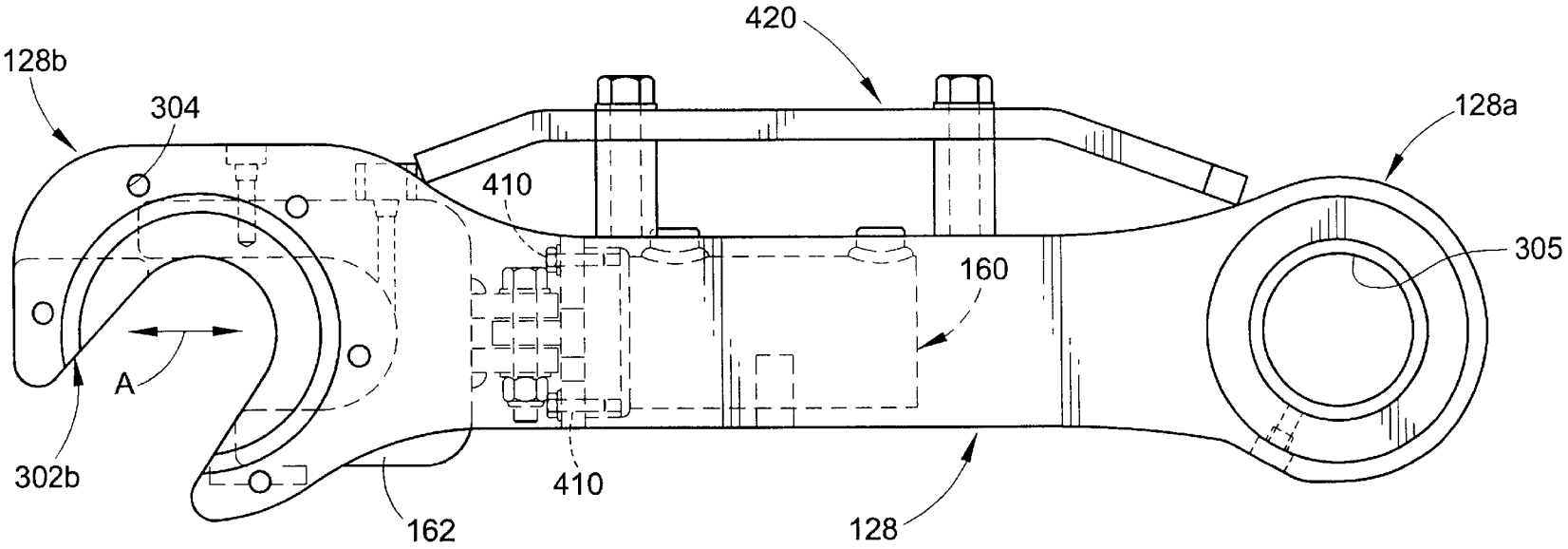

With reference to FIG. 8C, the implement link 128 defines a support 400 adapted for supporting the lock assembly 160. As shown in FIG. 9, the lock assembly 160 is placed on the support 400 and fasteners 410 are passed through apertures 402 defined in the support 400 and threadably connected to a mating portion of the lock assembly 160 to secure the lock assembly 160 in its operative position, with the lock member 162 adapted for selective reciprocal movement as indicated by the arrow A. A shroud 420 is preferably placed in spaced covering relation with the lock assembly to protect same from debris.

The invention has been described with reference to preferred embodiments. Of course, modifications and alterations will occur to others upon a reading and understanding of the preceding specification. It is intended that the invention be construed as including all such modifications and alterations insofar as they are encompassed by the following claims and equivalents.

Having thus described the preferred embodiments, what is claimed is:

1. An arm assembly comprising:

an arm member comprising: (i) a proximal end adapted for connection to an associated boom for pivoting movement about a transverse pivot axis; (ii) a distal end, spaced from said proximal end along a first longitudinal axis; and, (iii) a first recess defined in said distal end, said first recess defined about a first transverse axis that lies parallel to said transverse pivot axis and including an open mouth and a closed inner end;

an implement link member comprising: (i) a first end; and, (ii) a second end spaced from said first end along a second longitudinal axis and defining a second recess about a second transverse axis parallel to said first transverse axis, said second recess having an open mouth and a closed inner end, said first and second recesses adapted for respective receipt of first and second associated pins of an associated implement; and, at least one dude link member having a first end pivotably connected to said distal end of said arm member adjacent said first recess and a second end pivotably connected to said distal end of said implement link member adjacent said second recess, said first end of said dude link member defining a third recess having a mouth that opens in a first direction and said second end of said dude link member defining a fourth recess having a mouth that opens in a second direction that is generally opposite said first direction, said at least one dude link member movable between first and second operative positions in response to movement of said implement link member relative to said arm member wherein:

(i) in said first operative position, said mouth of said third recess of said dude link member is at least partially registered with said mouth of said first recess so that said first and third recesses are adapted for receipt of a first pin of an associated implement, and said mouth of said fourth recess is non-registered with said mouth of said second recess; and, (ii) in said second operative position, said mouth of said third recess is non-registered with said mouth of said first recess, and said mouth of said fourth recess is at least partially registered with said mouth of said second recess so that said second and fourth recesses are adapted for receipt of a second pin of an associated implement.

2. The arm assembly as set forth in claim 1, wherein open mouths of said first and second recesses are fixed in position relative to said first and second longitudinal axes, respectively.

3. The arm assembly as set forth in claim 2, further comprising:

a lock member secured to said implement link member and movable between a first position, wherein said lock member is non-interfering with said open mouth of said second recess, and a second position wherein said lock member at least partially closes said open mouth of said second recess.

4. The arm assembly as set forth in claim 1, wherein said second recess is movable relative to said first recess on an arc centered at said first transverse axis.

5. The arm assembly as set forth in claim 1, wherein said at least one dude link member pivots relative to said arm about said first transverse axis and pivots relative to said implement link member about said second transverse axis.

6. The arm assembly as set forth in claim 1 comprising:

first and second dude link members located on opposite lateral sides of said arm assembly.

7. The arm assembly as set forth in claim 1, further comprising:

a first retainer slidably secured to said arm assembly for movement on a circular arc about said first transverse axis;

a second retainer slidably secured to said implement link member for movement on a circular arc about said second transverse axis, wherein a first end of said dude link member is fixedly secured to said first retainer and an opposite second end of said dude link is fixedly secured to said second retainer.

8. The arm assembly as set forth in claim 1, wherein said closed inner ends of said first and second recesses are at least partially defined by partially cylindrical surfaces centered on said first and second transverse axes, respectively.

9. The arm assembly as set forth in claim 8, wherein said open mouths of said first and second recess are positioned diametrically opposed to said closed inner ends of said first and second recesses, respectively.

10. An arm assembly comprising:

an arm member comprising: (i) a proximal end adapted for connection to an associated boom for pivoting movement about a transverse pivot axis; (ii) a distal end, spaced from said proximal end along a first longitudinal axis; and, (iii) a first recess defined in said distal end, said first recess defined about a first transverse axis that lies parallel to said transverse pivot axis and including an open mouth and a closed inner end;

an implement link member comprising: (i) a first end; and, (ii) a second end spaced from said first end along a second longitudinal axis and defining a second recess about a second transverse axis parallel to said first transverse axis, said second recess having an open mouth and a closed inner end, said first and second recesses adapted for respective receipt of first and second associated pins of an associated implement; and, at least one dude link member having a first end pivotably connected to said distal end of said arm member adjacent said first recess and a second end pivotably connected to said distal end of said implement link member adjacent said second recess, said first end of said dude link member defining a third recess having a mouth that opens in a first direction and said second end of said dude link member defining a fourth recess having a mouth that opens in a second direction that is generally opposite said first direction, said at least one dude link member movable between first and second operative positions, wherein in said first operative position, said dude link at least partially blocks only a first one of said first and second recesses and in said second operative position said dude link at least partially blocks only a second one of said first and second recesses.

11. An arm assembly for an excavation apparatus, said arm assembly comprising:

an arm member comprising: (i) a proximal end adapted for operative connection to an associated boom for pivoting movement about a transverse pivot axis; (ii) a distal end, spaced from said proximal end along a first longitudinal axis; and, (iii) a first recess defined in said distal end, said first recess defined about a first transverse axis that lies parallel to said transverse pivot axis and including an open mouth and a closed inner end;

an implement link member comprising: (i) a first end adapted for operative connection to an associated fluid cylinder; and, (ii) a second end spaced from said first end along a second longitudinal axis and defining a second recess about a second transverse axis parallel to said first transverse axis, said second recess having an open mouth and a closed inner end, said first and second recesses adapted for respective receipt of first and second associated pins of an associated implement; and, at least one pin capturing link member including a first end pivotably connected to said distal end of said arm member adjacent said first recess, and a second end pivotably connected to said second end of said implement link member adjacent said second recess, said at least one pin capturing link member at all times, depending upon the relative location of said implement link member to said arm member, at least partially blocking said open mouth of at least one of said first recess and said open mouth of said second recess.

* * * * *